United States Patent [19]

Ferrari

[11] Patent Number: 4,988,095

[45] Date of Patent: Jan. 29, 1991

[54] EXERCISE APPARATUS

[76] Inventor: Carlo V. G. Ferrari, 51 Hyde Crescent, Hendon, London, NW. 9,, United Kingdom

[21] Appl. No.: 352,896

[22] Filed: May 17, 1989

[30] Foreign Application Priority Data

Feb. 7, 1989 [GB] United Kingdom ..... 8902631

[51] Int. Cl.[5] ..... A63B 21/06

[52] U.S. Cl. ..... 272/118; 272/117; 272/125; 272/130; 272/DIG. 4

[58] Field of Search ..... 272/93, 116–118, 272/122, 123, 125–138, 140–142, DIG. 4; 128/25 R

[56] References Cited

U.S. PATENT DOCUMENTS

| | | | |
|---|---|---|---|
| 3,638,941 | 2/1972 | Kulkens | 272/130 |
| 4,357,010 | 11/1982 | Telle | 272/117 |
| 4,358,107 | 11/1982 | Nissen | 272/136 X |
| 4,426,077 | 1/1984 | Becker | 272/130 X |
| 4,546,971 | 10/1985 | Raasoch | 272/117 X |
| 4,753,437 | 6/1988 | Lapcevic | 272/117 |
| 4,765,611 | 8/1988 | MacMillan | 272/123 X |

*Primary Examiner*—Stephen R. Crow
*Assistant Examiner*—Joe H. Cheng
*Attorney, Agent, or Firm*—Notaro & Michalos

[57] ABSTRACT

A weight stack training machine has a stack of weights 3 slidable vertically along a pair of guides 2 when lifted by a cable 7 which is connected to a hand grip or the like. In the upper part of the machine is an assembly for increasing the load felt by the user, consisting of a gas spring 18 connected between the machine frame 1 and an arcuate portion of a lever 11. At the opposite end of the lever is a pulley 12 around which passes a cable 13 anchored to the frame at 14 and connected at 15 to the weight selector rod 4. Listing the weights 3 causes the lever 11 to compress the spring 18 and give the user extra resistance.

18 Claims, 3 Drawing Sheets

EXERCISE APPARATUS

FIELD AND BACKGROUND OF THE INVENTION

This invention relates to weight training exercise apparatus, that is apparatus in which the user extends and contracts selected muscles or groups of muscles against the resistance of a weight.

In the early days of weight training, the apparatus used consisted of dumbbells and barbells. These articles suffered from inherent drawbacks, among them being instability, because they can be dropped, and awkwardness, because of the time necessary to change weights on them.

In the last few decades these drawbacks have been overcome by so-called weight stack exercise apparatus, in which a stack of incremental weights are guided for smooth vertical movement, a weight selector rod passes down through a plurality of vertically aligned bores and a selected weight is engaged with the rod by means of a pin passing through or under the weight and engaging in an aligned bore in the rod. In the exercise the whole stack of weights above the pin is lifted via the selector rod which is connected, for example, by a cable to hand grips or is directly connected, for example, to a lifting bar. In some arrangements there are more than one weight selector rod, and hereinafter the rod will be referred to broadly as "weight lifting means" to encompass the variety of arrangements possible.

The instability drawback is overcome by the guidance of the weights, and selection of different weights is made in seconds by withdrawing the selector pin from one weight and reinserting it in or against another. Weight stack exercise apparatus has therefore achieved widespread use, but although many drawbacks are overcome, there remain others which are inherent in the apparatus.

The main problem is the constraint which prevents the apparatus being useful to both light trainers and heavier trainers. Increments in weight are ideally small, say 5kg or 10kg. Thus ten weights would make up a 50 kg stack, but if say a 250kg maximum weight were wanted fifty weights would be necessary. Apart from the extra expense, there are inherent size limitations which prevent such a tall stack being viable. Conversely, to obtain a high maximum weight with a reasonable number of weights means that the increments, i.e. the sizes of each weight, are undesirably large. For this reason, commercial weight stack exercise apparatus has tended to be relatively lightweight, and users wanting high resistances have had to resort to barbells.

A second disadvantage, equally inherent in conventional barbells, is that the exercise resistance, ignoring friction or acceleration forces, is constant over the entire range of movement. Research has shown that this is not idea, but that for best results the resistance should vary over the range of movement. The devices which have been proposed in recent years to obtain improved contours of resistance to movement have involved complicated lever and/or cam mechanisms, which are expensive to manufacture and are prone to breakdown.

SUMMARY OF THE INVENTION

This invention in its essential form seeks to overcome the first disadvantage mentioned above, and, in a preferred embodiment, addresses the second.

According to the invention there is provided weight stack exercise apparatus including a gas spring selectively connectable to the weight lifting means in such a way as to increase the exercise resistance by an amount related to the force rating of the spring.

The term "gas spring" as used herein refers to a piston-cylinder assembly, otherwise known as a "gas cylinder", whose cylinder is pressurised causing differential forces on either side of the piston as a result of the connection to one side of the piston rod and having the effect of urging the rod out of the cylinder with a substantially uniform force, herein called the force rating, over its range of movements.

The benefit of the invention will become apparent from the following example. If the weight stack consists of ten 5kg weights the maximum effort is 50 with increments of 5kg. Now, connection to the weight lifting means of the gas spring whose force rating results in an increase of resistance at the stack of 50kg means that the maximum effort is now 100kg in increments of 5kg. To achieve this using the prior art would have involved twenty weights of 5kg making the stack twice as high, considerably more expensive, and probably unworkable. The amount of extra resistance (force rating) imparted by the gas spring is preferably equal to or a multiple of the weight of the stack.

The addition of a second such gas spring can raise the maximum effort to 150kg again in increments of 5kg. With the right design, the overall size of the machine need not be increased, the increase in weight is minimal and the extra cost is well worth the extra facility. As will become clear below, two or more gas springs may not be necessary; with the right system of leverage two or more increases in resistance can be obtained with a single gas spring.

The gas spring may be connectable between a frame of the apparatus and the lifting means. This more or less direct connection could be appropriate in for instance a bench press exerciser where the bar is in the form of a lever and is directly connected to the weight selector rod. The end of each gas spring may be selectively connectable to the lever by pin.

Alternatively the gas spring may be connectable between a frame of the machine and a remote pivot lever whereby lifting of the weight stack pivots the lever against the force of the spring. This arrangement means that the lever may be positioned anywhere in the apparatus which is conveniently accessible and is of particular benefit when the weight lifting means is lifted by a cable connected to the exercise point. Preferably, the torque at the lever is transferred to the weight selector rod by means of a cable.

Because the range of exercise movement can be substantially greater than the stroke of a suitable gas spring some means of gearing the two may be desirable. In a preferred arrangement the cable passes around a pulley disposed on the lever and is anchored at one end and connected to the weight lifting means at the other such that the pulley end of the lever moves a fraction, for example half, of the distance travelled by the weight lifting means.

The use of such a lever enables a single gas spring to provide a plurality of extra resistances depending on where it is connected to the lever. Preferably therefore the spring is selectively connectable to the lever at a plurality of points disposed along an arcuate portion thereof. The arc is necessary to enable the connection point to be readily changed at zero load, i.e. full extension, of the gas spring.

As mentioned above the force exerted by a gas spring may be substantially constant over its range of movement. However when it is acting upon a lever the perceived torque on the lever will vary as it rotates and the angle of the piston rod to the lever changes. This enables the invention to overcome the second drawback of weight stack apparatus because the geometry of the spring and the lever can be so arranged as to provide any desired variation of resistance with range of movement. This is particularly apposite, as it has been shown that athletes need a more pronounced variation in resistance over the range of muscle movement as they progress to higher resistances.

BRIEF DESCRIPTION OF THE DRAWINGS

In order that the invention may be readily understood certain embodiments will be described by way of example with reference to the accompanying drawings in which.

DESCRIPTION OF THE PREFERRED EMBODIMENT

Figure 1:
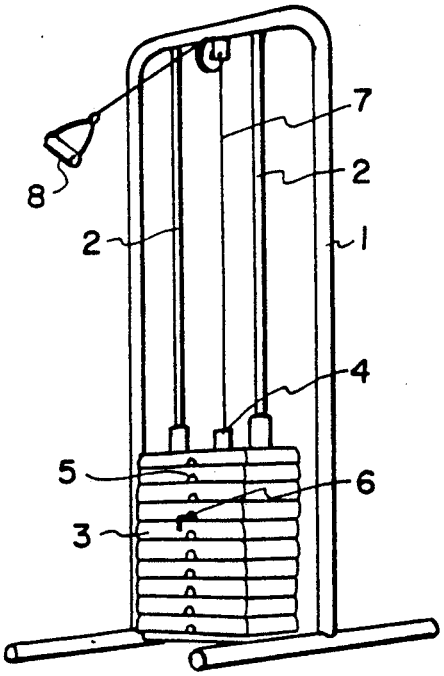
FIG. 1 (PRIOR ART)
FIG. 1 shows a simple weight stack exerciser of the prior art.

The prior art weight stack exercise apparatus shown in FIG. 1 consists of a support frame 1 holding a pair of vertical guides 2. A plurality of weights 3 each having a pair of bores to receive guides 2 are held in a stack on the guides. Weight lifting means in the form of a selector rod 4 passes down through central aligned apertures formed in the weights 3. Each weight has a frontwardly opening slot 5 which registers with a respective aperture (not shown) formed in the weight selector rod. The rod 4 is connected by a cable 7 to a handgrip 8, and it will be seen that by pulling in the handgrip 8 the stack of weights above pin 6 rises and exercise is provided by continued repetitions.

Figure 2:
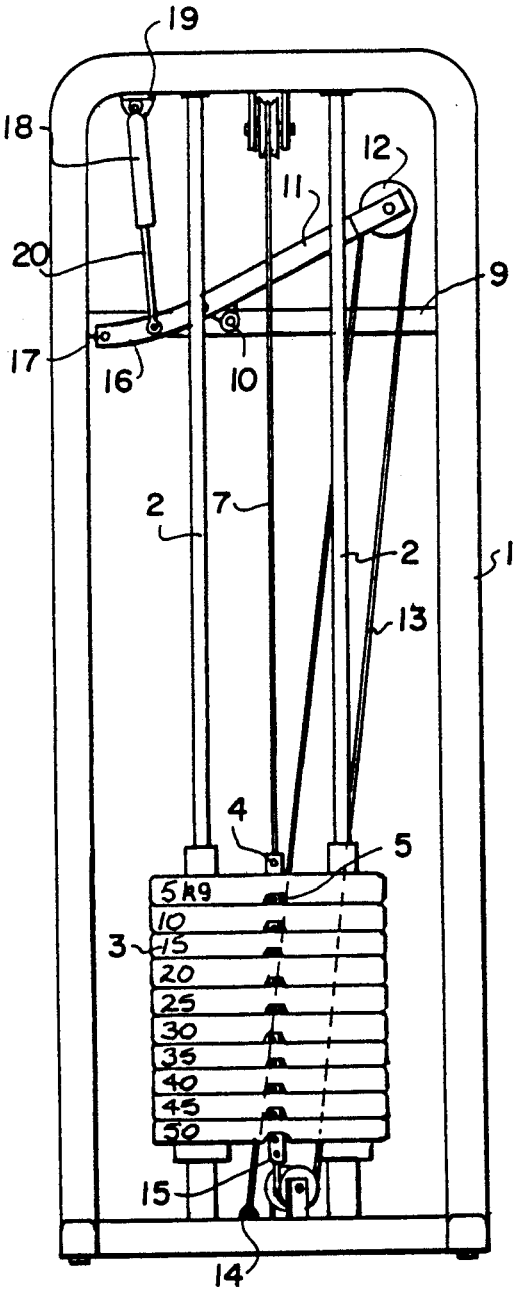
FIG. 2 shows the weight stack assembly of apparatus according to the invention.
Figure 3:
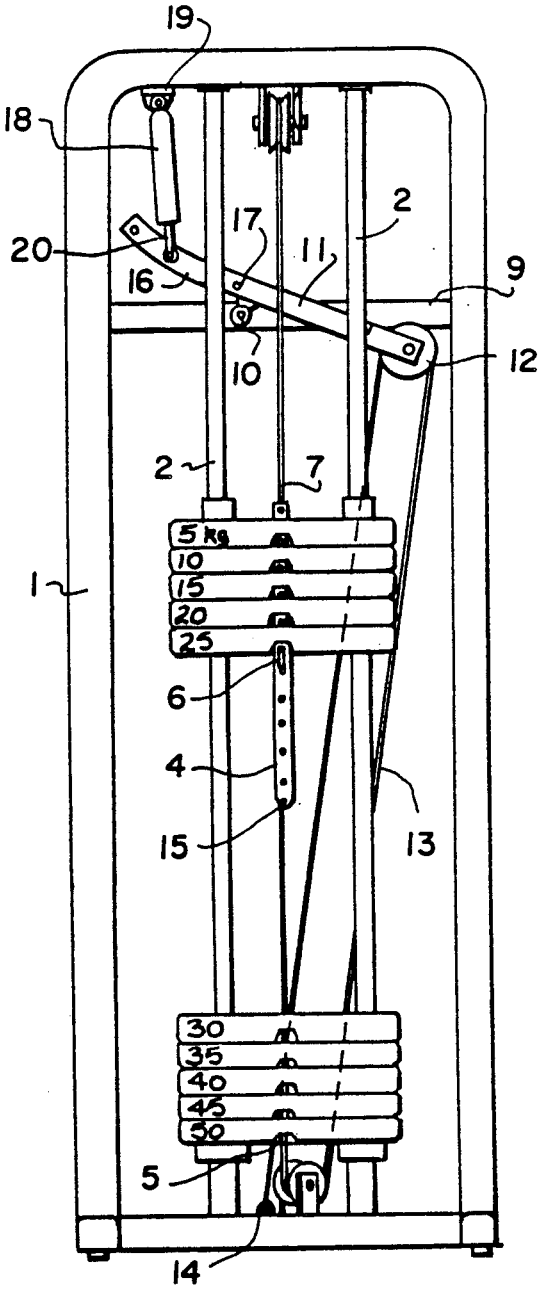
FIG. 3 is a view similar to FIG. 2 showing some weights raised.

FIGS. 2 and 3 show similar weight stack apparatus, but modified in accordance with the invention. The same parts are referred to by the same reference numerals. In this case however there is a transverse member 9 integrally connected to the upper part of the frame 1. Member 9 has a pivot pin 10 about which rotates a pivot lever 11.

Rotatably connected at one end of the lever 11 is a pulley 12. About the pulley 12 passes a cable 13 which is anchored at one end 14 and connected at the other end 15 to the bottom of the weight selector rod 4. It will thus be seen that raising of the weight stack 3 by given amount can only be achieved if the pulley 12 is pulled down by half that amount.

On the opposite side of the pivot lever 11 there is an arcuate portion 16 having formed therein three pin-engagable apertures 17. Directly above the arcuate portion 16 is a gas spring 18 pivotably connected to a bracket 19 attached to the frame 1. The piston rod 20 which extends from the cylinder is by means of a pin 21 engageable with a selected one of the three apertures 17. Raising of the lefthand end of the pivot lever 11 will meet resistance from the gas spring 18 dependent on its force rating. This resistance remains substantially constant over the whole range of movement of the piston rod into the cylinder, with only a small increase at full compression.

In the position shown in FIG. 2, i.e. with the weight stack at rest, the system is in equilibrium and the weight of the righthand side of the lever combined with that of the pulley 12 and cable 13 is taken up on the opposite side of the lever by the gas spring 18. However when the weight stack is raised as shown in FIG. 3, 25kg having been selected by the pin 6, the gas spring exerts a returning moment on the lever 11 which is perceived in the cable 13 as an additional load of 50kg making the actual resistance felt to be 75kg.

Figure 5:
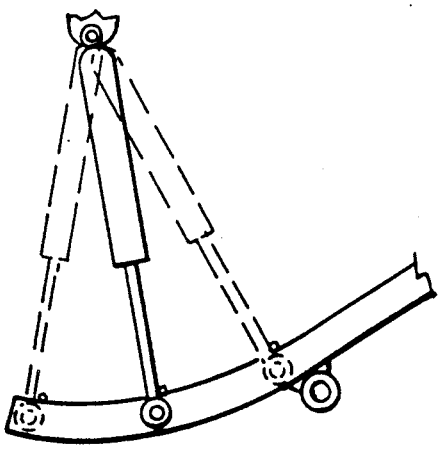
FIG. 5 is a close up scrap view of part of the assembly shown in FIG. 2 showing different configurations of the gas spring.
Figure 4:
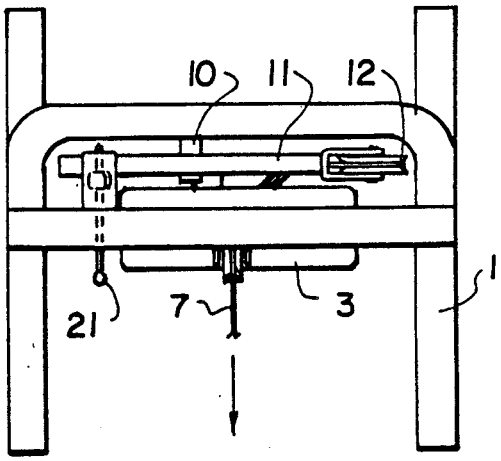
FIG. 4 is a plan view of the assembly shown in FIGS. 2 and 3.

FIG. 5 shows in detail the three connection positions of the piston rod 20 to the arcuate portion 16 of pivot lever 11. The central connection position shown in bold lines corresponds to FIG. 2. In the righthand connection position the force moment exerted on the lever 11 is small because the distance between the point of application of the force from the centre of the pivot is so small. This moment is just sufficient to counter-balance the weight of the other side of the lever 11, the pulley 12 and the cable 13. Thus with the spring connected in this position, the perceived resistance felt by the user is exactly that of the weights 3 which have been selected.

On the other hand, in the lefthand connection position shown in FIG. 5 the distance of the point of application of the moment force is double that of the central position, and the force rating of the spring is such that 100kg is added to the perceived resistance at the selector rod 4. Thus the resistance available in the apparatus has, by use of the invention, been tripled, yet the increase in total weight of the apparatus is modest, and the remote positioning of the lever/gas spring assembly means that there is not necessarily any overall increase in size. However the effect is that up to 150kg of resistance is available and, most importantly, the total resistance divides into small incremental steps of 5kg.

Figure 6:
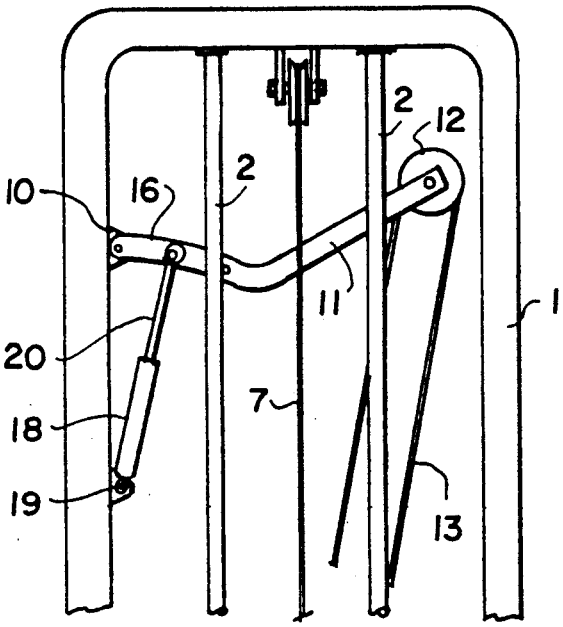
FIGS. 6 and 7 are part views similar to FIGS. 2 and 3 respectively of a modified assembly.
Figure 7:
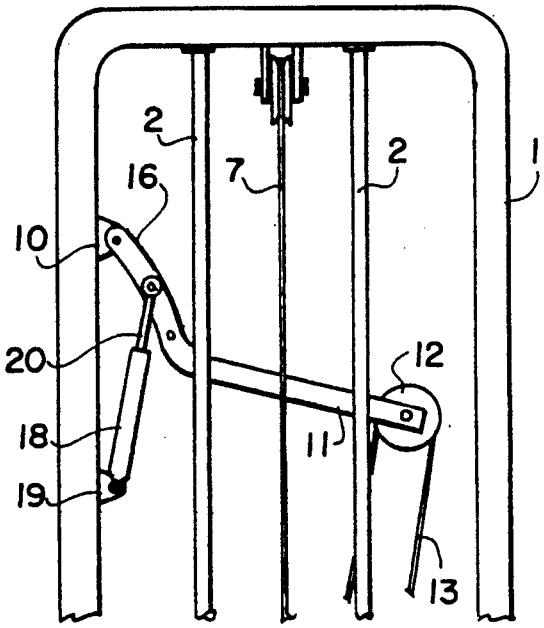

FIGS. 6 and 7 show a modified arrangement where the pivot lever 11 is pivotably connected at one end to the frame 1, and the gas spring 18, again connectable to the lever in three places over an arcuate portion, serves to restore the lever counterclockwise. The assembly otherwise operates in the same way as that described earlier.

Figure 8:
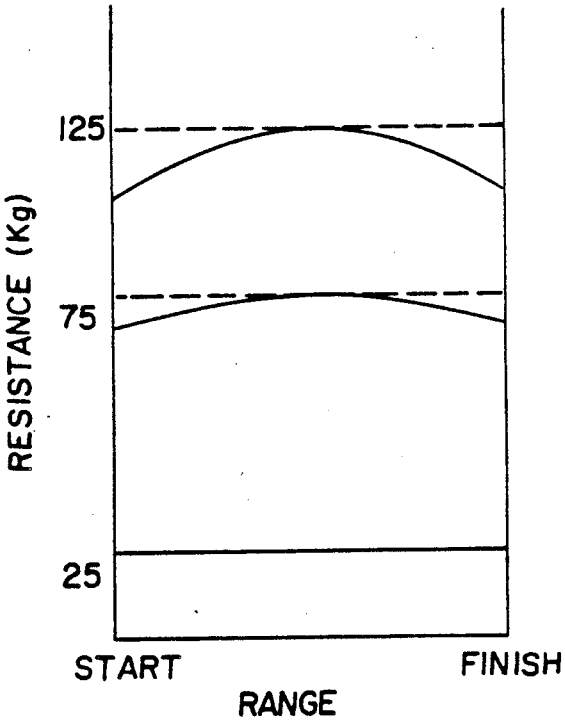
FIG. 8 is a plot of resistance against range of exercise movement for a selected exercise at different resistance levels.

Although the force exerted by the gas spring 18 is substantially constant, the turning moment applied to lever 11 does vary over the range of movement because of changes in the angle of the rod 20 to the lever 11. FIG. 8 shows the effect of this in practice. At a load of 50kg, that is without the gas spring causing any substantial moment on the lever 11, the resistance is substantially constant over the whole range of movement. However when the gas spring becomes effective, and in the example shown the total resistance here is 75kg, that is the 25kg of the weight stack plus 50kg from the gas spring, the resistance felt by the user is lower at the beginning and end of the range and peaks at the middle. At the higher setting of 125kg shown, again the resistance is lower at the beginning and end but here the peak is more pronounced .

Figure 9:
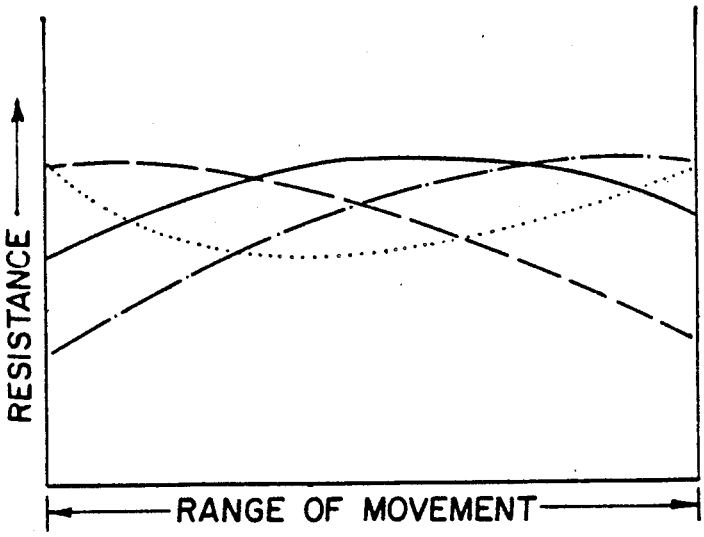
FIG. 9 is a plot similar to FIG. 8 showing different kinds of contour.

By suitably arranging the geometry of the gas spring 18 and lever 11 any desired contour of resistance vs range can be built into the machine. FIG. 9 shows contours which may be desired. The full line shows the resistance being greatest midway along the range of movement, the dash line shows the resistance being greatest at the commencement of the exercise, the dash-dot line shows the resistance greatest at the end, and the dotted line shows the resistance being least midway through the range of the exercise. These different contours will suit advanced athletes when exercising different muscles or muscle groups.

It will thus be seen that the invention provides at a modest increase in cost and weight the facility to multiply the amount of resistance of which the machine is capable yet maintaining relatively small incremental steps from zero up to maximum resistance. Thus weight stack machines which in the past have necessarily been largely restricted to lightweight users can be modified according to the invention to suit additionally those advanced athletes who require greater resistances. All this is achieved with an arrangement which is not mechanically complex, and indeed it is proposed that many existing weight stack machines will be readily convertible to function in accordance with the invention. This of course has the added advantage that it may not be necessary to have to purchase a new machine to take advantage of the substantial benefits afforded by the invention.

I claim:

1. An exercise apparatus, comprising:

a weight stack for providing an amount of resistance, wherein said weight stack is mounted for vertical movement on a frame;

weight lifting means operatively connected to said weight stack for lifting at least a portion of said weight stack against said amount of resistance by an user;

a compressible gas spring having a range of movement, said gas spring being compressible against a substantially uniform force rating over said range of movement, said gas spring being connected to said weight lifting means for increasing the amount of resistance for the user to lift said portion of the weight stack; and a pivot lever pivotally connected to said frame, wherein one end of said gas spring is connected to said frame and the other end of said gas spring is selectively connected to said pivot lever for providing a desired amount of resistance, said weight stack being connected to said gas spring through said pivot lever so that lifting of said portion of said weight stack causing rotation of said pivot lever, and said gas spring applying torque to said pivot lever in a direction for resisting said rotation of said pivot lever.

2. An apparatus according to claim 1, wherein said pivot lever includes a plurality of connection points, said gas spring being, being selectively connected to one of said connection points for changing the amount of torque applied by said gas spring to said pivot lever when said pivot lever is rotated.

3. An apparatus according to claim 2, wherein said pivot lever is pivotally mounted to said frame at a fulcrum, one of said connection points being adjacent said fulcrum so that when said gas spring is selectively connected to said pivot lever at said one connection point, substantially no torque is applied to said pivot lever by said gas spring when said pivot is rotated.

4. An apparatus according to claim 3, wherein said pivot lever is connected to said frame at a location above said weight stack.

5. An apparatus according to claim 3, wherein said weight stack has a total weight which provides an amount of resistance to said user on the weight lifting means for lifting the weight stack, said gas spring being selected to increase the amount of resistance by an integral multiple of the weight of said weight stack.

6. An apparatus according to claim 2, wherein said pivot lever is connected to said frame at a location above said weight stack.

7. An apparatus according to claim 1, wherein said pivot lever is connected to said frame at a location above said weight stack.

8. An apparatus according to claim 1, wherein said pivot lever has at least one arcuate portion, a plurality of connection points spaced along said arcuate portion, said gas spring being selectively connected between said frame and one of said connection points for applying different torque to said pivot lever as said pivot is rotated.

9. An apparatus according to claim 1, wherein said weight lifting means includes a selector rod extending along said weight stack, selector means for engaging said portion of the weight stack to said selector rod and a cable connected between said selector rod and said pivot lever for transferring the torque applied to said pivot lever by said gas spring, to said selector rod.

10. An apparatus according to claim 9, wherein said pivot lever is connected to said frame at a pivot location, and further including a pulley rotatably mounted to said pivot lever and spaced from said pivot location, said cable passing over said pulley, said cables having one end anchored to said frame and an opposite end connected to said selector rod so that when said pivot lever pivots, said pulley moves a fraction of the distance moved by said selector rod.

11. An apparatus according to claim 10, wherein said pivot lever has at least one arcuate portion, a plurality of connection points spaced along said arcuate portion, said gas spring being selectively connected between said frame and one of said connection points for applying different torque to said pivot lever as said pivot is rotated.

12. An apparatus according to claim 11, wherein said pivot lever is pivotally mounted to said frame at a fulcrum, one of said connection pints being adjacent said fulcrum so that when said gas spring is selectively connected to said pivot lever at said one connection point, substantially no torque is applied to said pivot lever by said gas spring when said pivot is rotated.

13. An apparatus according to claim 10, wherein said pivot lever is connected to said frame at a location above said weight stack.

14. An apparatus according to claim 10, wherein said gas spring is selectively connected to said pivot lever on one side of said location where said pivot lever is pivotally connected to said frame, and said pulley is connected to said pivot lever on a opposite side of said location.

15. An apparatus according to claim 10, wherein said location where said pivot lever is pivotally connected to said frame is at one end of said pivot lever, said pulley being connected to said pivot lever at an opposite end of said pivot lever, and said gas spring being selectively connected to said pivot lever at a location between the ends of said pivot lever.

16. An apparatus according to claim 9, wherein said pivot lever is connected to said frame at a location above said weight stack.

17. An apparatus according to claim 1, wherein said gas spring comprises the pressurized cylinder, a piston rod movably mounted along the range of movement to said cylinder, said piston being urged out of said cylinder by said substantially uniform force rating over said range of movement of said piston rod.

18. An apparatus according to claim 1, wherein said weight stack has a total weight which provides an amount of resistance to said user on the weight lifting means for lifting.

* * * * *